US007789483B2

(12) United States Patent
Tamaki et al.

(10) Patent No.: US 7,789,483 B2
(45) Date of Patent: Sep. 7, 2010

(54) CARRIAGE DRIVING UNIT AND IMAGE RECORDING APPARATUS

(75) Inventors: Shuichi Tamaki, Nagoya (JP); Toshio Sugiura, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 922 days.

(21) Appl. No.: 11/617,056

(22) Filed: Dec. 28, 2006

(65) Prior Publication Data

US 2007/0146422 A1 Jun. 28, 2007

(30) Foreign Application Priority Data

Dec. 28, 2005 (JP) ..... 2005-380147

(51) Int. Cl.
*B41J 23/00* (2006.01)

(52) U.S. Cl. ..... 347/37

(58) Field of Classification Search ..... 347/37
See application file for complete search history.

(56) References Cited

U.S. PATENT DOCUMENTS 6,932,732 B2 8/2005 Linck et al.
2005/0195242 A1 9/2005 Samoto et al.

FOREIGN PATENT DOCUMENTS

| | | | |
|---|---|---|---|
| JP | H06-073522 | U | 10/1994 |
| JP | H06-337056 | A | 12/1994 |
| JP | H08-270761 | A | 10/1996 |
| JP | H08-312758 | A | 11/1996 |
| JP | 2003-004126 | A | 1/2003 |
| JP | 2003-014069 | A | 1/2003 |
| JP | 2003-343700 | A | 12/2003 |
| JP | 2004-132433 | A | 4/2004 |
| JP | 2004-160479 | A | 6/2004 |
| JP | 2005-208277 | A | 8/2005 |
| JP | 2002-246907 | A | 9/2005 |
| WO | 01/81794 | A1 | 11/2001 |

*Primary Examiner*—Shih-wen Hsieh
(74) *Attorney, Agent, or Firm*—Baker Botts L.L.P.

(57) ABSTRACT

A carriage driving unit comprises a carriage, an timing belt, an timing belt, which is jointed to the carriage, looped around between a driving pulley attached to a driving shaft of a motor and a driven pulley attached to a driven shaft, a frame for rotatably supporting said driving shaft in a cantilever manner and a regulating projection for regulating the timing belt from displacing in a direction closer to said frame with respect to said driving pulley.

8 Claims, 9 Drawing Sheets

CARRIAGE DRIVING UNIT AND IMAGE RECORDING APPARATUS

CROSS-REFERENCE TO RELATED APPLICATIONS

This Nonprovisional application claims priority under 35 U.S.C. §119(a) on Patent Application No. 2005-380147 filed in Japan on Dec. 28, 2005, the entire contents of which are hereby incorporated by reference.

BACKGROUND OF THE INVENTION

1. Field of the Invention

The present invention relates to a carriage driving unit for reciprocating a carriage mounted with a recording head or the like via a timing belt driven by a motor, and to an image recording apparatus utilizing the carriage driving unit.

2. Description of Related Art

In a conventional image recording apparatus, since easy to manufacture, there has been used a toothed driving pulley 100 formed with a flange 104 only at a side opposite to a flat surface 102 as shown in FIG. 1 (Japanese Patent Application Laid-Open No. 2005-246907). The toothed driving pulley 100 is attached to a driving shaft of a drive motor 108 attached to a guide member 106. And a timing belt 110 is laid around between the toothed driving pulley 100 and a driven pulley (not shown).

However, when the toothed driving pulley 100, which is formed with the flange 104 only at one side, is driven to rotate by the drive motor 108, the timing belt 110 occasionally moves toward the flat surface 102 where the flange 104 is not formed as indicated with double-dotted lines in FIG. 1. On the flat surface 102, there are various protruding items, for example, catches 114 for connecting the guide member 106 and a frame body 112, fixing portions 116 used for inserting to attach a holder for rotatably supporting spurs (not shown) to the guide member 106 and the like.

In order to prevent the timing belt 110 from coming into contact with these projections and getting damaged even when the timing belt 110 moves toward the flat surface 102 indicated with the double dotted lines in FIG. 1, a sufficient space is ensured between the timing belt 110 and the projections. Therefore, there resides such a disadvantage that the height of the toothed driving pulley 100 and the timing belt 110 from the flat surface 102 become considerably high resulting in a increase of size of the carriage driving unit.

BRIEF SUMMARY OF THE INVENTION

The present invention has been proposed to solve the above disadvantage. An object of the present invention is to provide a carriage driving unit, the height and dimensions of which are reduced, and an image recording apparatus.

A carriage driving unit according to a first aspect of the invention comprises a toothed driving pulley which is driven to rotate by a motor, a driven pulley which is rotatably supported, a timing belt which is laid around between said toothed driving pulley and said driven pulley, a carriage which is fixed to said timing belt and supported so as to reciprocate via said timing belt driven by the motor, and a regulating projection for regulating displacement of said timing belt, wherein said toothed driving pulley and said driven pulley is disposed on a frame so that the rotating center there of is substantially vertical with respect to a flat surface, said toothed driving pulley comprises a flange only at a side opposite to the flat surface, said regulating projection is formed so as to protrude from said flat surface toward the side face of said timing belt, and the height position of said regulating projection is higher than a protruding item disposed between said surface and the side face of the timing belt.

The carriage driving unit according to a second aspect of the invention is the carriage driving unit according to the first aspect of the invention wherein the regulating projection is formed separately from the frame and attached to the frame.

The carriage driving unit according to a third aspect of the invention is the carriage driving unit according to the first aspect of the invention further comprising a spacer interposed between the motor and the frame wherein the regulating projection is formed integrally with the spacer.

The carriage driving unit according to a fourth aspect of the invention is the carriage driving unit according to the third aspect of the invention wherein the regulating projection is a projecting piece formed so as to protrude from the spacer, and the frame provides an insertion hole for allowing the protruding piece to be inserted therethrough.

The carriage driving unit according to a fifth aspect of the invention is the carriage driving unit according to the first aspect of the invention wherein the regulating projection is disposed in the vicinity of the motor.

The carriage driving unit according to a sixth aspect of the invention is the carriage driving unit according to the first aspect of the invention wherein the regulating projection is made by pressing a metal plate.

The carriage driving unit according to an seventh aspect of the invention is the carriage driving unit according to the first aspect of the invention wherein the regulating projection has a curved surface of a convex shape disposed so as to oppose to an edge portion in a width direction of the timing belt.

An image recording apparatus according to a eighth aspect of the invention comprises: a carriage driving unit according to the first aspect of the invention, a carriage mounted with a recording head and driven by the carriage driving unit; and a carrying unit for carrying a sheet to an area opposing to the recording head mounted on the carriage; wherein the recording head is driven to reciprocate to record an image on the sheet carried by the carrying unit.

Since the carriage driving unit of the present invention is provided with the regulating projection for regulating displacement of the timing belt, the following advantages can be achieved; i.e., the side face of the timing belt comes into contact with the regulating projection to prevent the timing belt from further displacing, and thus the timing belt is prevented from coming into contact with a protruding items causing a damage thereon; the timing belt may be disposed closer to the supporting projection; and the height from the frame can be reduced and the size of the carriage driving unit can be reduced.

Since the regulating projection is formed separately from the frame and attached to the frame, the regulating projection can be formed easily. Also, since the regulating projection is provided in the vicinity of the motor, the displacement of the timing belt can be effectively prevented. Moreover, since the regulating projection is formed by a press and front end thereof is formed in a curved surface having a convex shape, the regulating projection can be easily formed, and the timing belt can be prevented from being damaged caused from a contact of the side face of the timing belt.

Since the spacer is interposed between the motor and the frame and the regulating projection is formed on the spacer, the position of the motor can be lowered by a distance equal to the thickness of the spacer, and thus the height of the toothed driving pulley from the flat surface can be easily reduced and the regulating projection can be easily formed.

Moreover, these carriage driving units are suitably applicable to the image recording apparatus.

The above and further objects and features of the invention will more fully be apparent from the following detailed description with accompanying drawings.

DETAILED DESCRIPTION OF THE INVENTION

Figure 1:
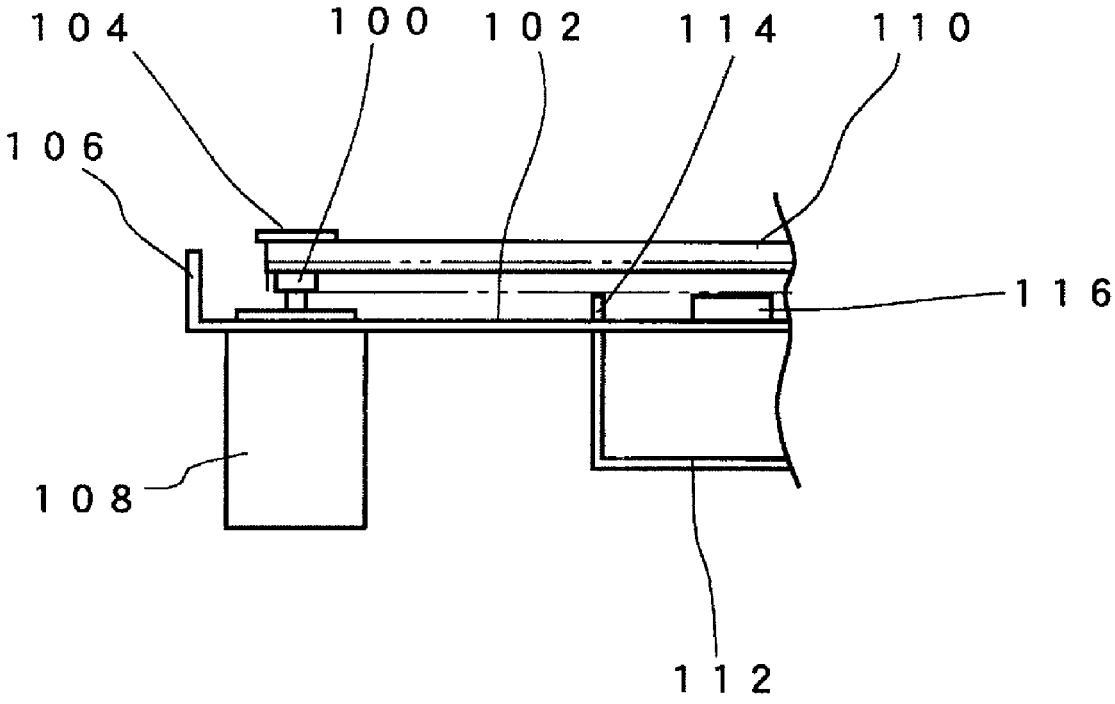
FIG. 1 PRIOR ART
FIG. 1 is an explanatory view showing a conventional assembly relationship among a drive motor, a toothed driving pulley and a guide member.
Figure 2:
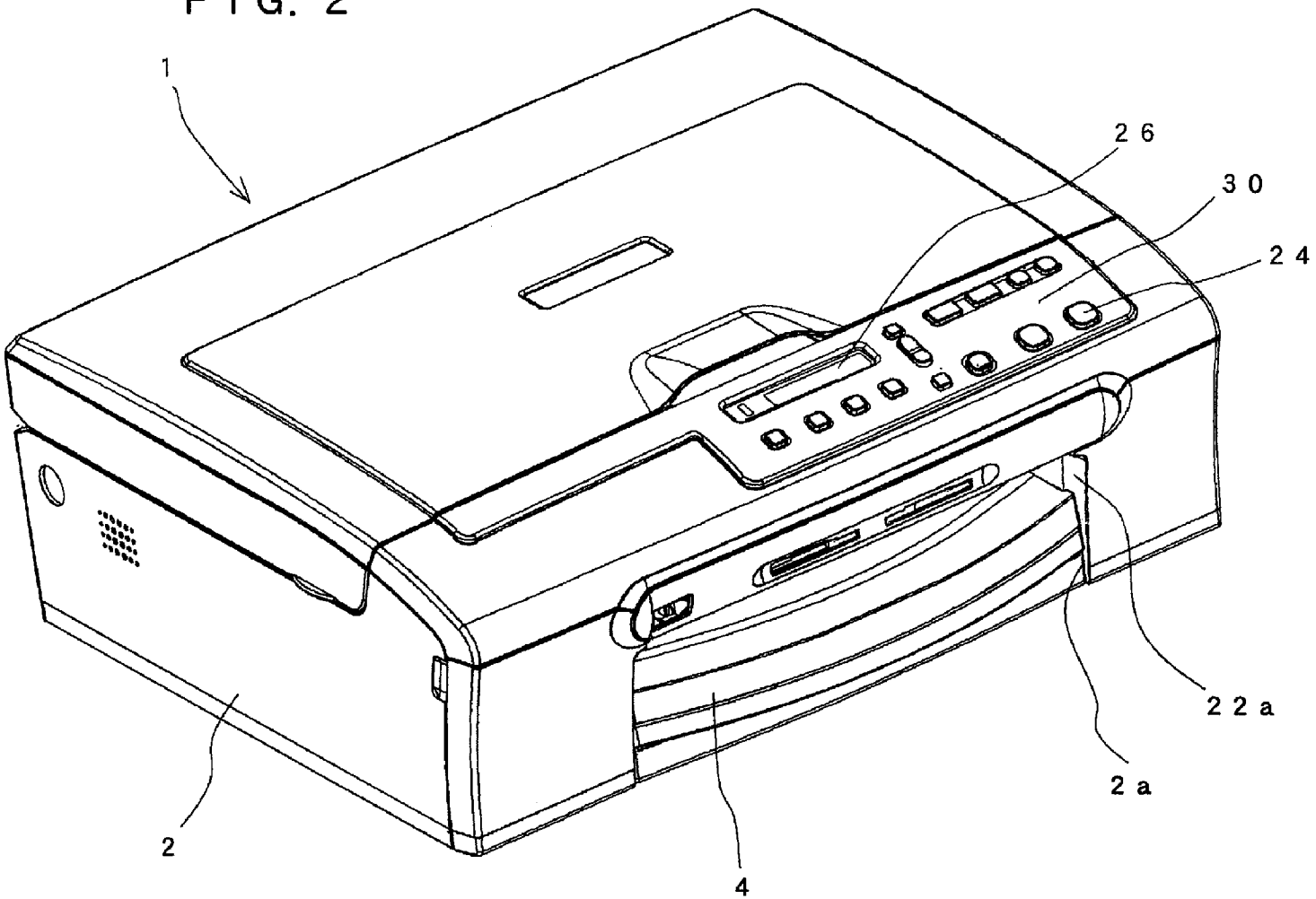
FIG. 2 is a perspective view of an image recording apparatus in accordance with an embodiment of the present invention.
Figure 3:
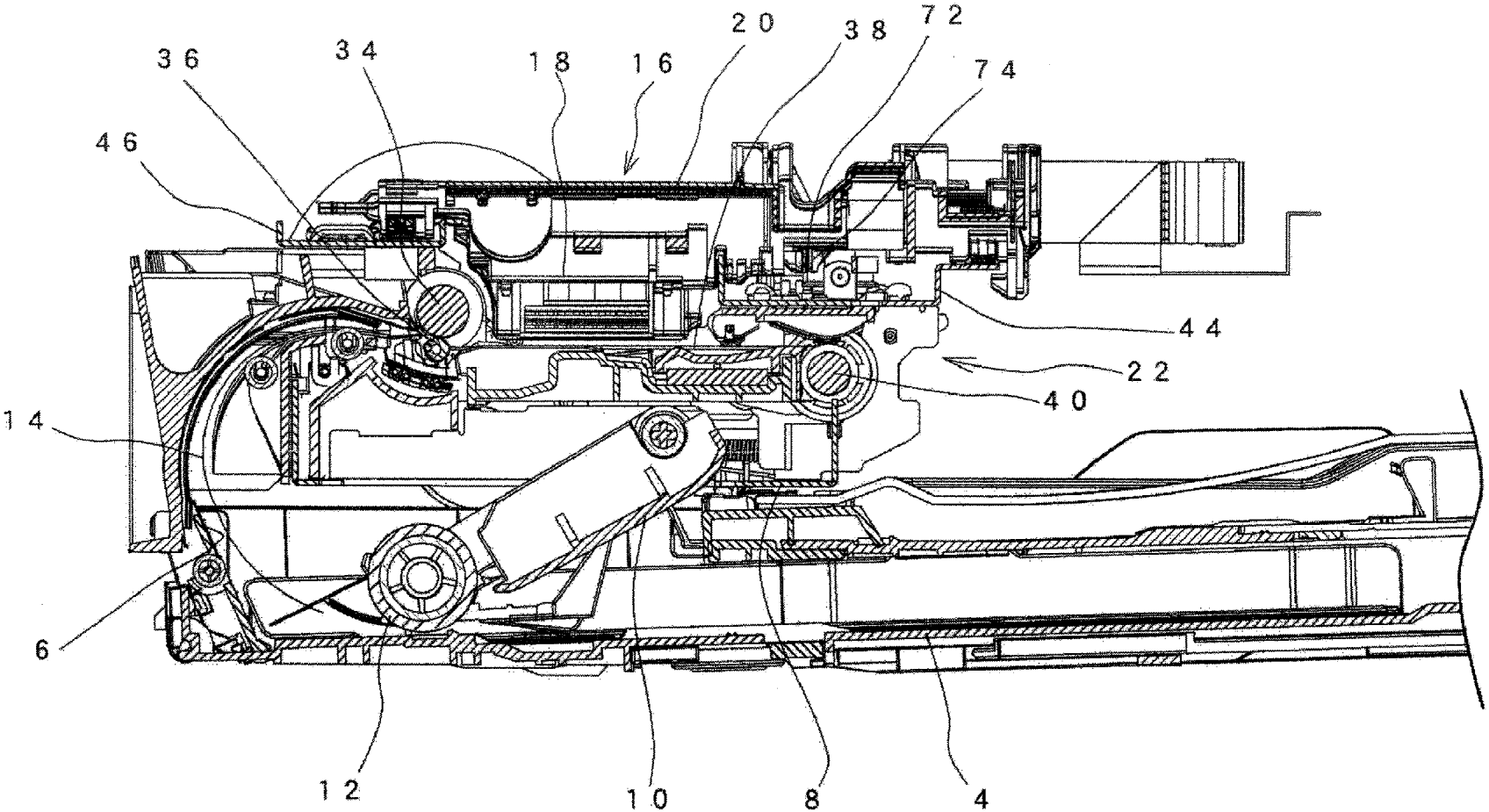
FIG. 3 is a cross sectional view of an essential portion of the image recording apparatus in accordance with the embodiment.

Best mode for carrying out the present invention will be hereinafter described in detail with reference to the drawings. FIG. 2 is a perspective view of an image recording apparatus in accordance with an embodiment of the present invention, and FIG. 3 is a cross sectional view of an essential part thereof.

The image recording apparatus 1 in accordance with the present invention is a multi function device (MFD) having a printing function, a copier function, a scanner function and a facsimile function. As shown in FIG. 2, disposed in a bottom area of a housing 2 composed of an injection mold of a synthetic resin, which is a recording apparatus body in the image recording apparatus 1, is a sheet tray 4, which can be mounted and dismounted from a front opening 2*a* thereof.

In this embodiment, the sheet tray 4 is arranged so as to receive a plurality of sheets cut into, for example, A4 size, letter size, B5 size, post card size or the like and stacked therein with a shorter side of the sheets extending in a direction orthogonal to a sheet carrying direction. And disposed at the back side of the sheet tray 4 as shown in FIG. 3 is a bank portion 6 for separating a sheet from the stacked sheets.

Inside the box-like main frame 8, a sheet feeder arm 10 is mounted so that a base end portion thereof can rotate in a vertical direction. It is arranged so that a sheet feeder roller 12 provided at the lower end of the sheet feeder arm 10 and the bank portion 6 separate the sheets stacked in the sheet tray 4 one after another and carry the sheet. The separated sheet is carried through a U-turn path (sheet carrying path) 14, which is oriented upward and then backward, and is fed to a printing mechanism 16 disposed above the sheet tray 4. The printing mechanism 16 is composed of an inkjet recording head 18, a carriage driving unit 21 that drives the carriage 20, on which the recording head 18 is mounted, to reciprocate and the like.

A sheet discharge section 22, onto which the sheet recorded with an image by the printing mechanism 16 is discharged with the recorded surface thereof at the upper side, is formed above the sheet tray 4, and the sheet discharge port 22*a* communicated with the sheet discharge section 22 is opened commonly with the opening 2*a* in the front face of the housing 2.

In an upper area of the printing mechanism 16 in the housing 2, an image scanner (not shown), which reads an image from an original or the like for the copier and facsimile functions, is disposed. Disposed on the upper face of the housing 2 is an operation panel section 30 having a various operation buttons 24, a liquid crystal display 26 and the like as shown in FIG. 2.

A pair of resist rollers 34, 36 for feeding the sheet below the lower face of the recording head 18 is disposed at an upstream side of a platen 38 disposed therebetween. A discharge roller 40 for carrying the printed sheet to a sheet discharge section 22 is disposed at a downstream side of the platen 38.

Figure 4:
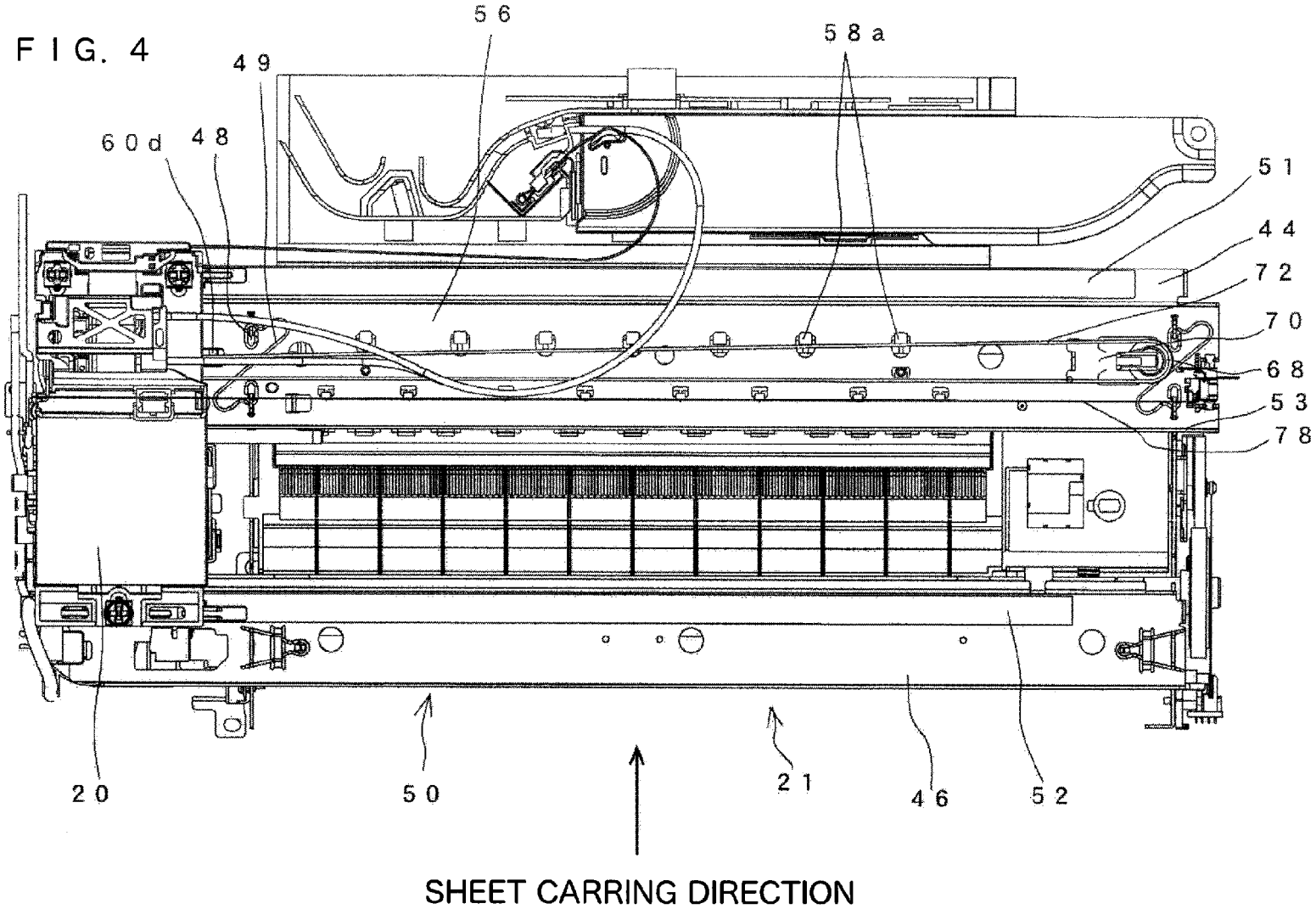
FIG. 4 is a plan view of a carriage driving unit 21 of the embodiment.
Figure 5:
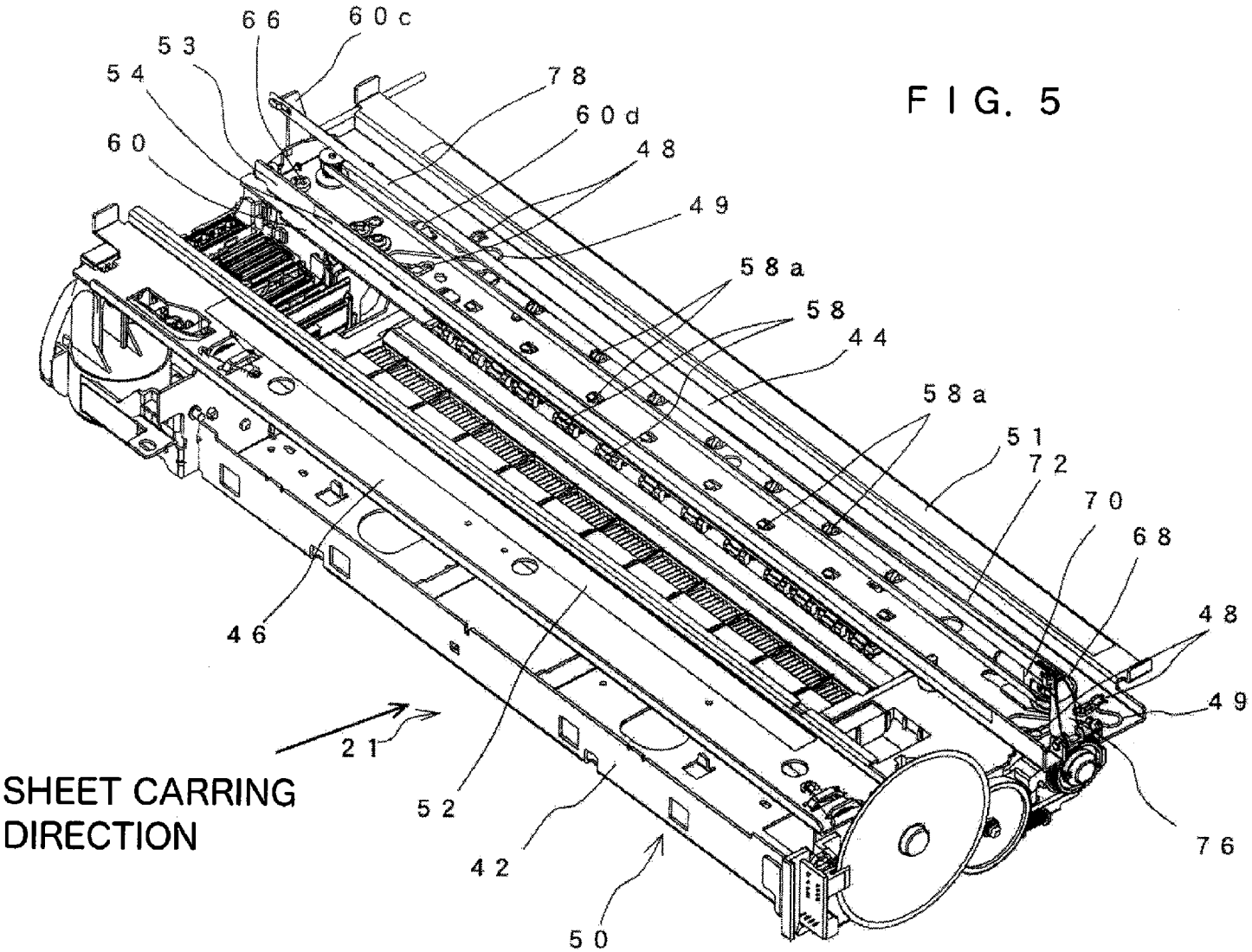
FIG. 5 is a perspective view of the carriage driving unit 21 of the embodiment.
Figure 6:
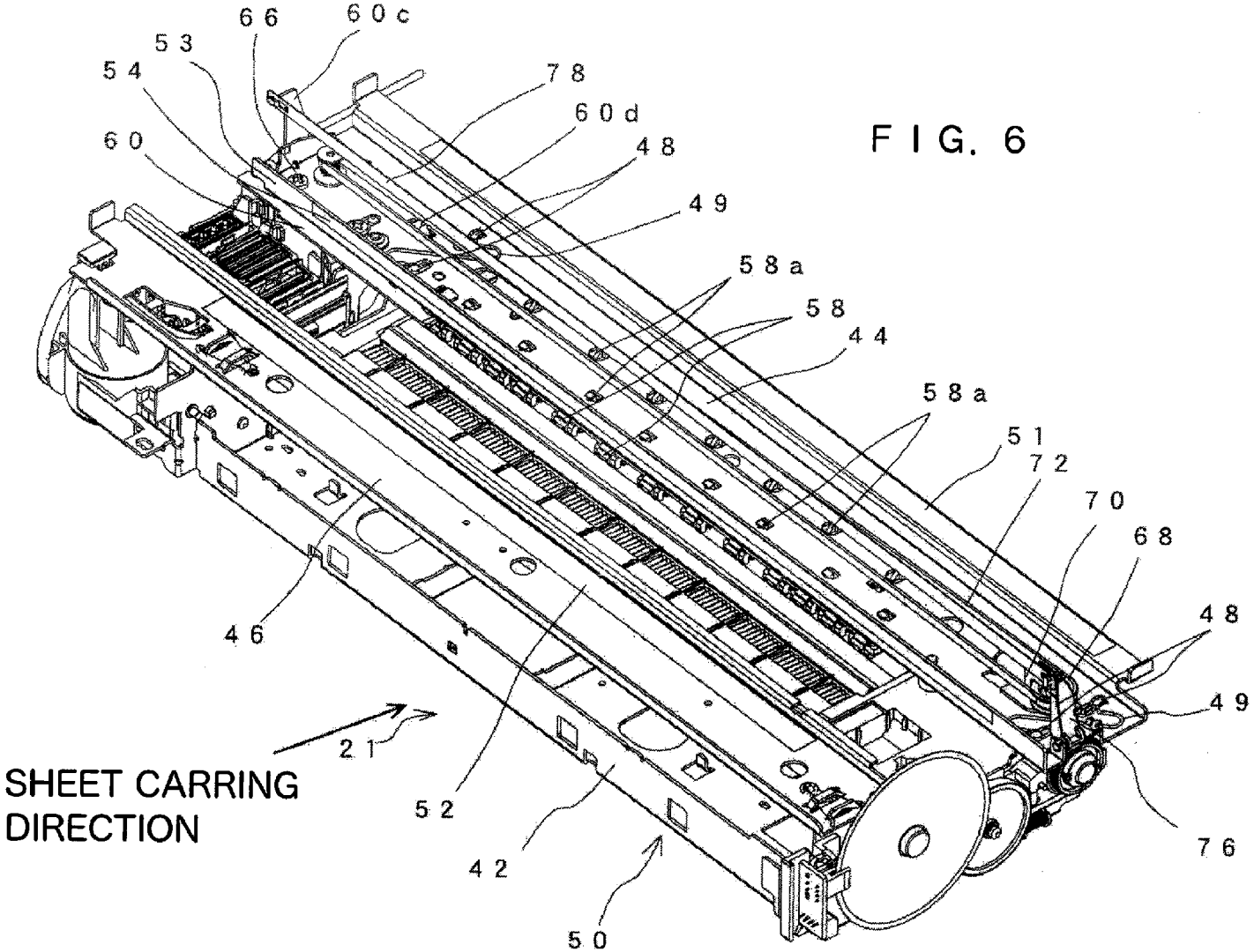
FIG. 6 is a perspective view of the carriage driving unit 21 of the embodiment, in which the recording head 18 and the carriage 20 are removed therefrom.
Figure 7:
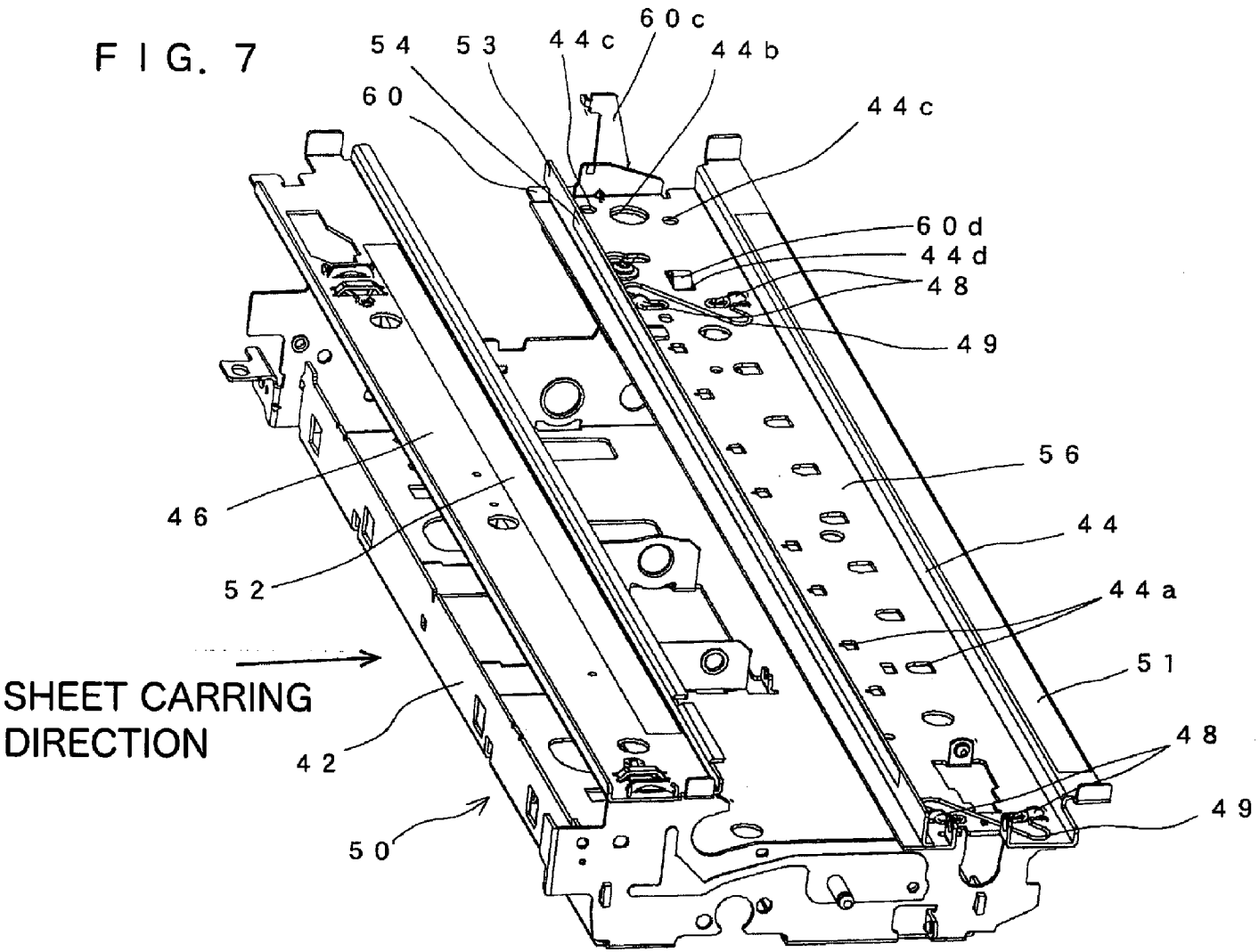
FIG. 7 is an enlarged perspective view of a frame of the embodiment.
Figure 8:
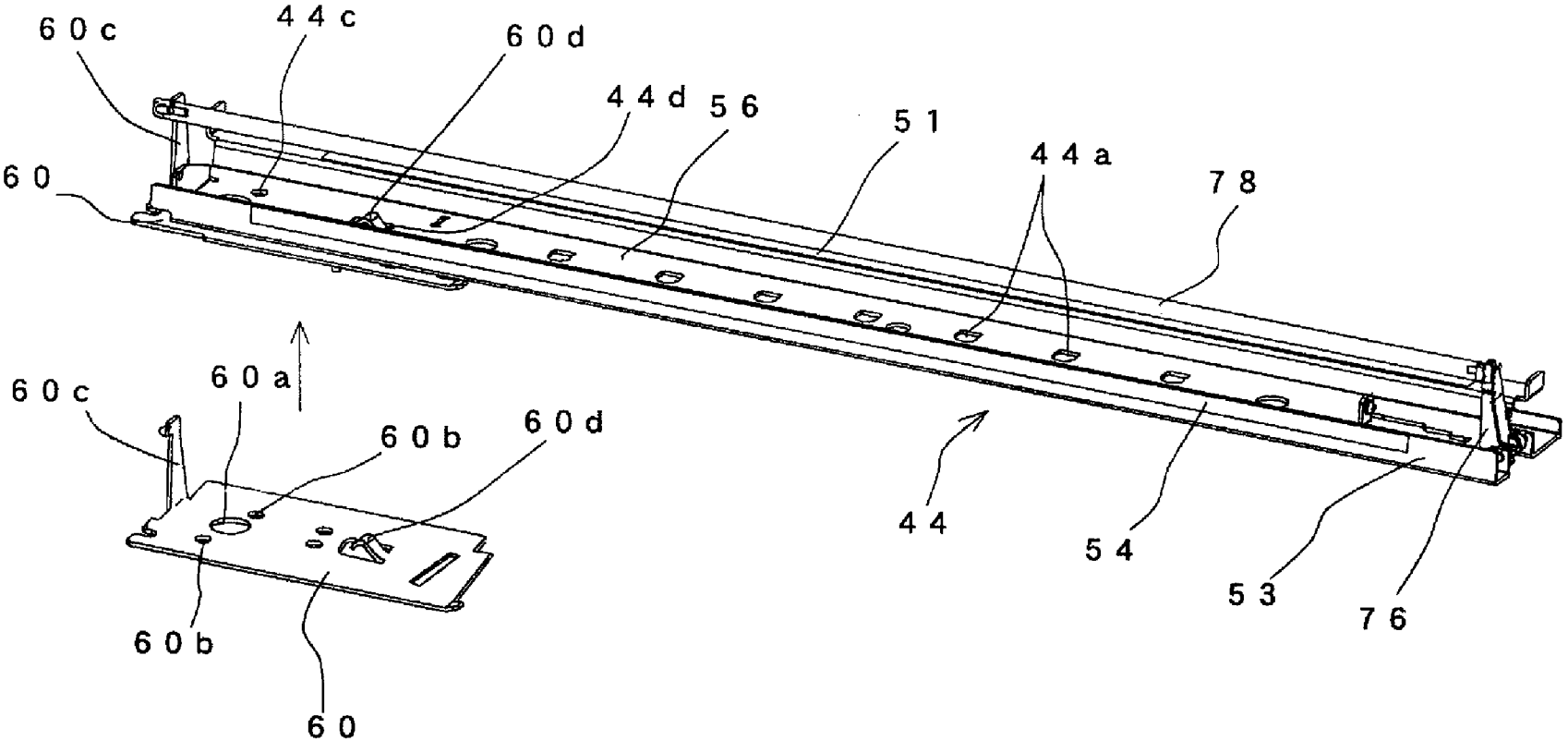
FIG. 8 is an enlarged perspective view of a guide member of the embodiment.
Figure 9:
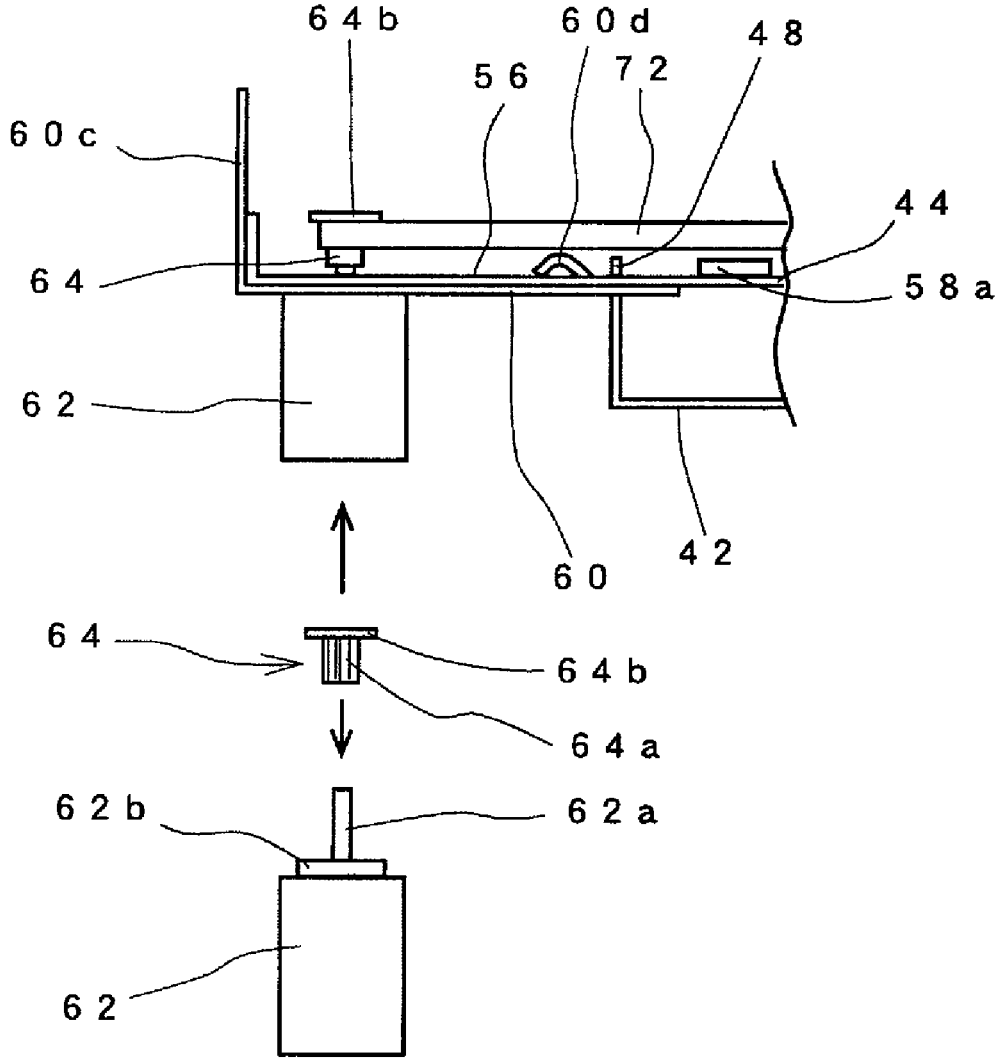
FIG. 9 is an explanatory view showing an assembly relationship of a drive motor, a toothed driving pulley, a spacer, and a first guide member in the embodiment.

Next, the carriage driving unit 21 used in the printing mechanism 16 will be described in detail. FIG. 4 is a plan view of the carriage driving unit 21 of the embodiment; FIG. 5 is a perspective view of the carriage driving unit 21 of the embodiment; FIG. 6 is a perspective view of the carriage driving unit 21 of the embodiment, in which the recording head 18 and the carriage 20 are removed therefrom; FIG. 7 is an enlarged perspective view of the frame of the embodiment; FIG. 8 is an enlarged perspective view of a guide member of the embodiment; and FIG. 9 is an explanatory view showing an assembly relationship of a drive motor, a toothed driving pulley, a spacer, and a first guide member in the embodiment.

A frame body 42 is formed by punching a sheet of a metal plate into a predetermined shape, and then bending the same into a box-like shape having an open upper portion as shown in FIGS. 4 to 7. Also, on an upper portion of the frame body 42, first and second guide members 44, 46 are attached leaving a space for allowing the recording head 18 to enter therebetween. In the first guide member 44, a plurality of catches 48 of the frame body 42 are inserted, and hooking members 49 are hooked to the catches 48 and thereby the frame body 42 and the first guide member 44 are positioned and fixed to each other. In this embodiment, the frame 50 is composed of the frame body 42 and the first and second guide members 44, 46.

Each of the first and second guide members 44, 46 is formed with a horizontal sliding surface 51, 52, which is parallel to a lower surface (a head surface formed with nozzles) of the recording head 18 mounted on the carriage 20. Also, in a substantially vertical guide piece 53 in the first guide member 44, an upstream side of which in the sheet carrying direction is bent upward, vertical sliding surfaces 54 orthogonal to the sheet carrying direction are formed at both sides of the guide piece 53.

The carriage 20 mounted with the recording head 18 is disposed being bridged between the first and second guide members 44, 46 being in contact with the horizontal sliding surfaces 51, 52 and the vertical sliding surface 54 in a sliding manner, and supported by the frame 50 so as to reciprocate.

The first guide member 44 is formed with a flat surface 56 between the horizontal sliding surface 51 and the vertical sliding surface 54 along a direction orthogonal to the sheet carrying direction. The catches 48 inserted through the first guide member 44 protrude from the flat surface 56. Also, fixing portions 58*a* of a spur holder 58, which rotatably support spurs (not shown), are inserted through insertion holes

44*a* in the first guide member 44, and the fixing portions 58*a* protrude from the flat surface 56.

The first guide member 44 is provided with a drive motor 62 being interposed by a plate-like spacer 60 in one end in a direction orthogonal to the sheet carrying direction and at a side opposite to the flat surface 56 as shown in FIG. 7 and FIG. 8.

A driving shaft 62*a* of the drive motor 62 is fitted with a toothed driving pulley 64 as shown in FIG. 9. The toothed driving pulley 64 includes a toothed portion 64*a* and a flange 64*b*; and the flange 64*b* is formed at only a side opposite to the flat surface 56.

The first guide member 44 and the spacer 60 are formed with a fitting hole 44*b*, 60*a* respectively with which a cap 62*b* of the drive motor 62 is fitted as shown in FIGS. 7 to 9. The first guide member 44 and the spacer 60 are overlapped with each other, the cap 62*b* is inserted through the fitting holes 44*b*, 60*a*, and a screw 66 is inserted into mounting holes 44*c*, 60*b* formed in the first guide member 44 and the spacer 60. Thus the first guide member 44, the spacer 60 and the drive motor 62 are integrally secured. With this arrangement, the toothed driving pulley 64 is disposed on the frame 50 so that the rotating center thereof is substantially vertical with respect to the flat surface 56.

Further, the first guide member 44 is provided with a driven pulley 68 at the other end in a direction orthogonal to the sheet carrying direction. The driven pulley 68 is supported rotatably by a tension imparting mechanism 70 and attached to the first guide member 44 via the tension imparting mechanism 70. The tension imparting mechanism 70 rotatably supports the driven pulley 68 parallel to the rotating center of the toothed driving pulley 64 and energizes the driven pulley 68 with a spring or the like in a direction that the driven pulley 68 is departed away from the toothed driving pulley 64. With this arrangement, the driven pulley 68 is disposed on the frame 50 so that the rotating center of the driven pulley 68 is substantially vertical to the flat surface 56.

An endless timing belt 72 (toothed belt) having a ring-like shape is laid around on the toothed driving pulley 64 and the driven pulley 68 therebetween. The timing belt 72 is imparted with an appropriate tension by the tension imparting mechanism 70. In this embodiment, the driven pulley 68, which is formed with flanges on both sides thereof, is used.

The timing belt 72 is laid around between the toothed driving pulley 64 and the driven pulley 68; thus the timing belt 72 is positioned at the upstream side and the downstream side in the sheet carrying direction between the toothed driving pulley 64 and the driven pulley 68 across the sheet carrying direction. A securing member 74 attached to the carriage 20 nips and holds a part of the timing belt 72 at the upstream side of the sheet carrying direction, and thus the carriage 20 is fixed to the timing belt 72.

Further, an encoder strip 78 orthogonal to the sheet carrying direction is provided between a support 60*c* upstanding on the spacer 60 and a support 76 supported by the first guide member 44 at an end thereof at the side of the driven pulley 68.

The spacer 60 is formed with a regulating projection 60*d* for regulating displacement of the timing belt 72, which protrudes toward the first guide member 44 in the vicinity of the drive motor 62. And the first guide member 44 is formed with an insertion hole 44*d*, through which the regulating projection 60*d* is inserted when the spacer 60 is attached to the first guide member 44.

In this embodiment, the spacer 60 is formed by pressing a sheet material. Therefore, the fitting hole 60*a*, the mounting hole 60*b*, the support 60*c* and the regulating projection 60*d* are formed by a press. The regulating projection 60*d* is formed in a convex shape protruding toward the first guide member 44 by forming a cut in a U-like shape by a press first, and then by bending the cut into an inverted U-like shape. The regulating projection 60*d* is formed so that the front end having a convex shape is curved in a smooth arc shape as viewed in section.

The regulating projection 60*d* is formed so as to protrude from the flat surface 56 through the insertion hole 44*d* when the spacer 60 is attached to the first guide member 44 from the opposite side of the flat surface 56. The regulating projection 60*d* is disposed under the timing belt 72 laid around between the toothed driving pulley 64 and the driven pulley 68 at the downstream side. That is, in this embodiment, the regulating projection 60*d* is disposed under the timing belt 72 at the opposite side of the timing belt 72 secured by the securing member 74. And the regulating projection 60*d* protrudes from the flat surface 56 toward the side face of the timing belt 72.

The regulating projection 60*d* protruding from the flat surface 56 is formed a little higher than the height of the protruding items such as the catches 48 and the fixing portions 58*a* protruding from the flat surface 56. The protruding items are items that come in contact with the side face of the timing belt 72 when the timing belt 72 is displaced toward the flat surface 56 and are disposed between the flat surface 56 and the side face of the timing belt 72.

Now, operation of the carriage driving unit 21 of this embodiment will be described below together with operation of the image recording apparatus 1. First of all, sheets are set into the sheet tray 4, and then the sheet tray 4 is inserted from the opening 2*a*, thus the sheet tray 4 is mounted onto the image recording apparatus 1. An uppermost sheet is separated from the sheets stacked in the sheet tray 4 and carried in the carrying direction by the sheet feeder roller 12. When the front end of the sheet comes into contact with a nip-portion between the resist rollers 34, 36, the sheet is stopped once and a skew of the sheet is corrected, if any.

Then, the driving resist roller 34 is driven to rotate in the carrying direction to carry the sheet a predetermined amount to a predetermined standby position. When carrying out the printing, the driving resist roller 34 is driven to rotate in the carrying direction to feed the sheet in the carrying direction.

Synchronous with the carrying of the sheet, the drive motor 62 is driven via the toothed driving pulley 64 and the timing belt 72 to reciprocate the carriage 20 along the vertical sliding surface 54, and ink is discharged from the recording head 18 to form an image on the sheet.

When the carriage 20 is driven to reciprocate, the toothed driving pulley 64 is driven to rotate by the drive motor 62, and thereby the timing belt 72 is driven to rotate accordingly. While the timing belt 72 is driven to rotate, there is a case that the timing belt 72 comes closer to the flat surface 56 by some reason. Even when the timing belt 72 displaces toward the flat surface 56, the side face of the timing belt 72 comes into contact with the regulating projection 60*d* and is prevented from displacing any more. Accordingly, the timing belt 72 is prevented from coming into contact with protruding items such as catches 48 or fixing portions 58*a* causing a damage the timing belt 72.

By forming the regulating projection 60*d*, the timing belt 72 can be disposed closer to the flat surface 56, and thus the height from the flat surface 56 can be reduced. Accordingly, the size of the carriage driving unit 21 can be reduced. Also, since the front end of the regulating projection 60*d* is formed in an arc shape as viewed in cross section, even when the side face of the timing belt 72 comes into contact and is ground with the regulating projection 60*d*, the timing belt 72 can be prevented from being damaged. Further, since the regulating projection 60*d* is formed on the small spacer 60 separately from the frame 50, the regulating projection 60*d* can be formed easily by a press.

Since it is not necessary to form a toothed portion corresponding to the timing belt 72 on the driven pulley 68, even when the flanges are formed on both sides, the driven pulley 68 can be easily manufactured. Contrarily, the toothed driving pulley 64 has to be formed with the toothed portion 64*a*. When the flanges are formed on both sides, it is difficult to manufacture the toothed driving pulley 64. Therefore, the flange 64*b* is formed at only one side to facilitate the manufacture of toothed driving pulley 64.

Therefore, at the side of the driven pulley 68, there is no problem such that the timing belt 72 displaces toward the flat surface 56. By forming the regulating projection 60*d* in the vicinity of the drive motor 62, the displacement of the timing belt 72 can be effectively prevented.

Since the spacer 60 is interposed between the drive motor 62 and the first guide member 44, the position of the drive motor 62 is lowered by a distance equal to the thickness of the spacer 60. Accordingly, the height of the toothed driving pulley 64 from the flat surface 56 can be easily reduced. And by forming the regulating projection 60*d*, even when the timing belt 72 is positioned closer to the flat surface 56, the conventional drive motor 62 can be used without changing the configuration of the motor.

In this embodiment, the regulating projection 60*d* is formed below the timing belt 72 at the downstream side. The side of the timing belt 72 secured by the securing member 74 is prevented from displacing by the securing member 74. However, when the carriage 20 moves toward the driven pulley 68, the distance between the securing member 74 and the toothed driving pulley 64 becomes longer. Therefore, in the case where there is a possibility that the timing belt 72 at the upstream side displaces toward the flat surface 56, the regulating projection 60*d* may be disposed under the timing belt 72 at the upstream side.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A carriage driving unit comprising:

a toothed driving pulley which is driven to rotate by a motor;

a driven pulley which is rotatably supported;

a timing belt which is laid around between said toothed driving pulley and said driven pulley;

a carriage which is fixed to said timing belt and supported so as to reciprocate via said timing belt driven by the motor; and a regulating projection for regulating displacement of said timing belt; wherein said toothed driving pulley and said driven pulley is disposed on a frame so that a rotating center thereof is substantially vertical with respect to a flat surface;

said toothed driving pulley comprises a flange only at a side opposite to the flat surface;

said regulating projection is formed so as to protrude from said flat surface toward a side face of said timing belt; and a height position of said regulating projection is higher than a protruding item disposed between said flat surface and the side face of the timing belt.

2. The carriage driving unit according to claim 1, wherein said regulating projection is formed separately from said frame and attached to said frame.

3. The carriage driving unit according to claim 1, further comprising a spacer interposed between said motor and said frame; wherein said regulating projection is formed integrally with said spacer.

4. The carriage driving unit according to claim 3, wherein said regulating projection is a projecting piece formed so as to protrude from said spacer, said frame provides an insertion hole for allowing said protruding piece to be inserted therethrough.

5. The carriage driving unit according to claim 1, wherein said regulating projection is disposed in the vicinity of said motor.

6. The carriage driving unit according to claim 1, wherein said regulating projection is made by pressing a metal plate.

7. The carriage driving unit according to claim 1, wherein said regulating projection has a curved surface of a convex shape disposed so as to oppose to an edge portion in a width direction of said timing belt.

8. An image recording apparatus comprising:

a carriage driving unit according to claim 1;

a carriage mounted with a recording head and driven by said carriage driving unit; and a carrying unit for carrying a sheet to an area opposing to the recording head mounted on the carriage; wherein said recording head is driven to reciprocate to record an image on the sheet carried by said carrying unit.

* * * * *